United States Patent [19]

Khakzad-Ghomi

[11] Patent Number: 4,643,650

[45] Date of Patent: Feb. 17, 1987

[54] FLUID-RAISING APPARATUS DRIVEN BY LOW HYDRAULIC HEAD

[76] Inventor: Abdol-Hossein Khakzad-Ghomi, No. 122, Ekhtiarieh Ave., Shemiran, Tehran, Iran

[21] Appl. No.: 801,236

[22] Filed: Nov. 25, 1985

[51] Int. Cl.[4] ..... F04B 23/14; F04F 11/00; F04F 1/18

[52] U.S. Cl. ..... 417/90; 417/101; 417/108; 417/109

[58] Field of Search ..... 417/54, 65, 85, 86, 417/90, 91, 101, 108, 109, 150

[56] References Cited

U.S. PATENT DOCUMENTS

| | | | |
|---|---|---|---|
| 592,037 | 10/1897 | Young et al. | 417/87 |
| 779,456 | 1/1905 | Young et al. | 417/54 |
| 859,213 | 7/1907 | Gill | 417/150 |
| 885,301 | 4/1908 | Siepermann et al. | 417/150 |
| 900,669 | 10/1908 | Coxe | 417/86 |
| 1,091,313 | 3/1914 | Erickson | 417/101 |
| 2,461,032 | 2/1949 | Bush | 417/108 |
| 2,945,447 | 7/1960 | Yamaguchi et al. | 417/90 |
| 3,028,816 | 4/1962 | Walker et al. | 417/108 |
| 4,110,980 | 9/1978 | Foulke | 417/108 X |
| 4,265,599 | 5/1981 | Morton | 417/54 |

FOREIGN PATENT DOCUMENTS

| | | | |
|---|---|---|---|
| 2097485 | 11/1982 | United Kingdom | 417/503 |

*Primary Examiner*—Carlton R. Croyle
*Assistant Examiner*—Paul F. Neils
*Attorney, Agent, or Firm*—Klarquist, Sparkman, Campbell, Leigh & Whinston

[57] ABSTRACT

A fluid-raising apparatus includes a compression chamber which receives liquid, from an elevated source, such that gas in the chamber is pressurized and used to lift fluid through a vertical conduit. When the chamber fills with liquid, a float lifts a drain plug so that draining commences automatically. The effluent passes through a discharge tube wherein, during draining, the liquid pushes on a piston. The piston, in turn, holds a liquid inlet valve closed until draining is complete.

22 Claims, 2 Drawing Figures

FLUID-RAISING APPARATUS DRIVEN BY LOW HYDRAULIC HEAD

SUMMARY OF THE INVENTION

This invention relates to a device for moving a liquid or free flowing powder to a higher elevation. More particularly, it relates to such a device which uses, as its power source, a low head of water or other locally available liquid.

In the past, pumps and other mechanical devices have been driven by compressed air produced from a low water pressure head. In some such devices, as shown in U.S. Pat. No. 4,265,599 (Morton), a compresser chamber is used to provide a source of pressurized air. The air drives a piston or is routed into an airtight chamber where it pushes out water by displacement. Such devices are less than fully efficient. Friction dissipates energy in the mechanical devices; and, due to the compressability of air, direct displacement of water is not particularly efficient. It is a further disadvantage that, in such prior devices, the compressor requires much supervision or extensive mechanical controls.

It is known to lift a fluid in a vertical pipe by air injection. This is shown in U.S. Pat. No. 592,037 (Young et al.). But, again, a rather complex air compressor apparatus is used. Multiple air lift pipes have been used in some installations as shown in FIG. 4 of U.S. Pat. No. 2,461,032 (Bush). A related disclosure is found in U.S. Pat. No. 3,028,816 (Walker et al.), which shows a plurality of air lift pumps, each having an automatic valving device at its discharge end to prevent backflow of water through the pump if air supply to that pump is discontinued.

Other devices which make use of entrained air are shown in U.S. Pat. No. 859,213 (Gill) and 4,110,980 (Foulke). U.S. Pat. No. 2,945,447 (Yamaguchi et al.) describes a hydraulic ram.

While each of these pior inventions contributed to the art in some way, there has still been no suggestion of how one could most efficiently raise a fluid using, for a power source, a relatively low head of liquid from a nonsurging source. And, particularly, there has been no way to accomplish this with simple, automated equipment.

It has now been discovered that a steady flow of liquid from a relatively low elevation can be used to raise a stream of this same or a different fluid. A liquid stream enters a compression chamber which is filled with a gas and adapted automatically to receive the flow of liquid, so that gas is compressed, by displacement, in the chamber. The compressed gas is automatically channeled, in bursts, into a gaslift pump mechanism which carries any desired liquid or free flowing solid stream to a much higher elevation. The chamber is equipped to operate automatically with simple mechanisms that, during draining, prevent or retard the flow of new liquid into the chamber but allow gas to enter. Such mechanisms also automatically close the drain, prevent the induction of further gas, and reestablish the flow of influent liquid as soon as the draining cycle is complete.

Among the unique apparatus developed is a drain control which includes a buoyant drain plug adapted to form a seal with a drain seat and a float which rides on the surface of liquid in the chamber. A flexible line connects the plug and the float such that, when the maximum amount of liquid is reached, the float pulls the plug out of the seat to commence draining. The bouyant plug floats until draining is complete, whereupon the plug returns to the seat where it remains while the chamber refills with liquid.

Another particular advance is a valve which controls the flow of liquid into the chamber. The valve includes an inlet plug mounted selectively to close the inlet through which liquid enters the chamber, a discharge tube which connects the chamber to the drain outlet, a piston loosely contained in the discharge tube, and a linkage connecting the piston to the inlet plug in such a manner that, as liquid drains from the chamber, the piston is pushed toward the drain, which causes the inlet plug to at least partially close the liquid inlet.

An object of the invention is to provide an automatic, yet simple fluid-raising apparatus to raise a liquid or solid fluid stream to a higher elevation.

Another object is to provide a fluid-raising apparatus with as few moving parts as possible to reduce maintenance.

An additional object is to provide a fluid-raising apparatus that can be manufactured simply by adding control equipment to an existing, installed tank.

A further object is to provide a fluid-raising apparatus which includes no electrical controls and thus can be used safely in an environment where there is a higher risk of explosion or fire.

Yet another object is to provide a fluid-raising apparatus suitable for unattended use in a remote location or one where there is no permanent source of electrical power.

These and other objects of the invention will become readily apparent to those skilled in the art upon reading the following detailed description.

DETAILED DESCRIPTION

Figure 1:
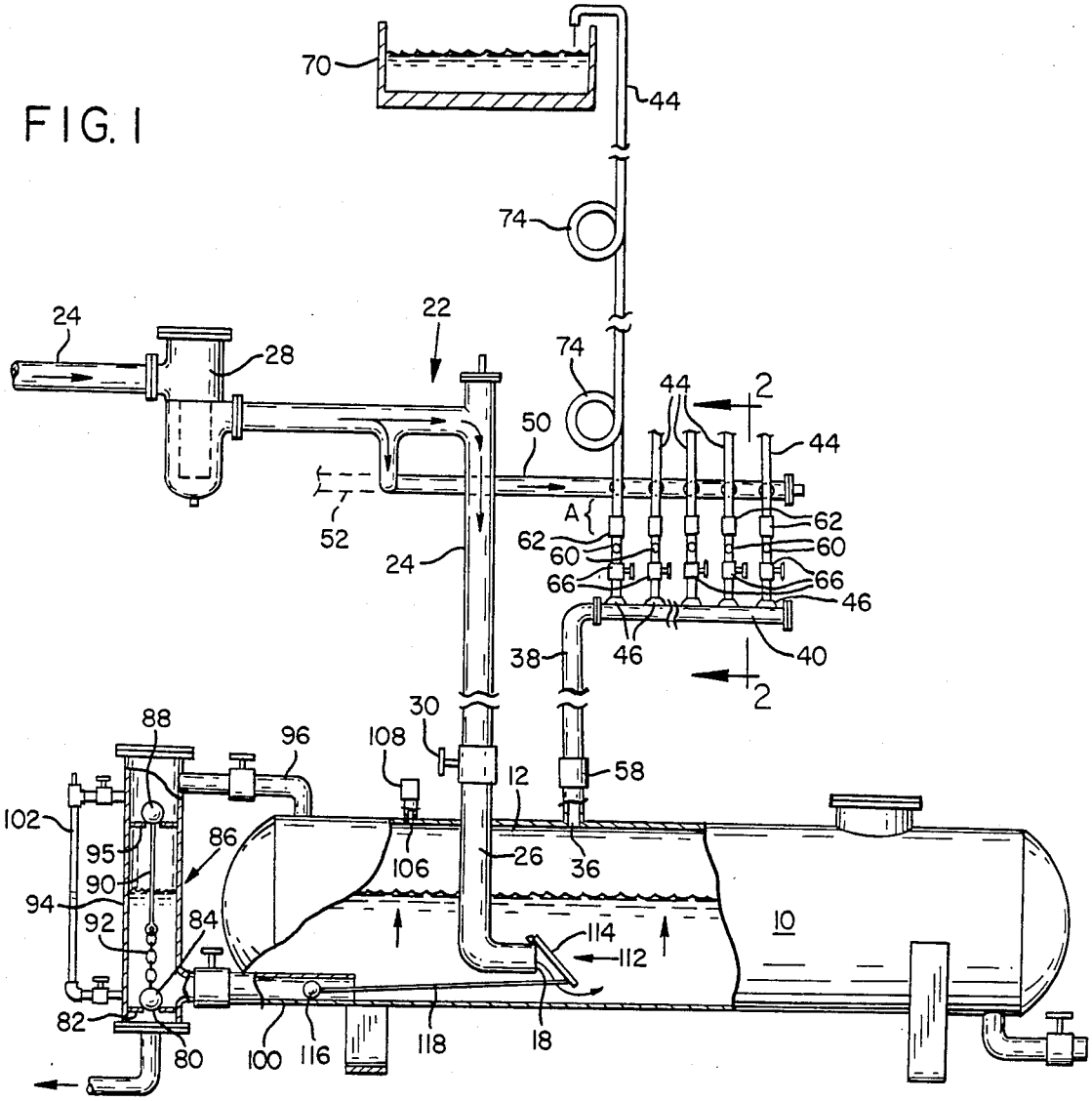
FIG. 1 is a vertical elevational view of a fluid-raising apparatus according to the present invention, with portions broken away to show internal structure.
Figure 2:
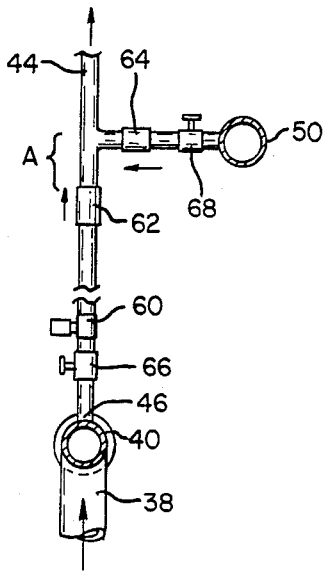
FIG. 2 is a partial vertical sectional view taken along line 2—2 of FIG. 1.

As shown in the drawings, a preferred embodiment of the present invention includes a tank 10 which defines an airtight chamber 12.

A liquid inlet 18 is provided to admit a stream of liquid into the chamber 12. In the illustrated embodiment, the liquid is delivered to the inlet via a supply pipe system 22 which connects to an elevated source of liquid such as a river or reservoir (not shown) with a surface as little as one foot above the tank 10. Liquid enters the pipe system 22 via a pipe 24. An extension 26 of pipe 24 extends into the tank itself and defines the inlet 18. One or more strainers of the type shown at 28 may be included in the pipe system 22 as needed to remove suspended solids from the liquid. An isolation valve 30 is provided to stop the flow of influent liquid in order to take the apparatus off line for inspection or maintenance. Optionally, this valve could also be pressure-actuated, set to close automatically if pressure in the pipe 26 exceeds or drops below desired amounts.

A gas outlet 36 is provided in the top of tank 10 to allow gas, displaced by entering liquid, to escape from the chamber 12. The gas outlet connects, via a pipe 38 and manifold 40, with multiple upwardly extending fluid conduits 44 at junctions 46 which are located below the tops of the conduits. The manifold 40 can be installed adjacent the tank or located a distance away and connected to the gas outlet 36 with piping. For example, the manifold could be located at the bottom of a subterranean well (not shown) and joined by piping to a tank 10 at ground level. Or, the tank 10 could be located at the bottom of a canyon and the manifold 40 at the top.

A fluid supply pipe 50 also connects with the conduits 44. The pipe 50 serves as a fluid supply means which delivers fluid into a staging zone or region A which exists in each conduit 44 between the junction 46 and the top of the conduit. When gas is injected into the conduit, fluid in its region A is launched upwardly by the injected gas which, due to its buoyancy, rises.

In the illustrated embodiment, the pipe 50 is a part of the pipe system 22 so that fluid in the pipe 50 is the same as the liquid in pipe 24 (the same as is used to fill the chamber 12). Alternatively, the pipe 50 could be isolated from the pipe system 22 so that fluid received in the pipe 50, as for example via an extension 52, could be from an entirely different source. The illustrated embodiment would, for example, likely be preferred if an elevated water source such as a lake or river was to be used both to power the apparatus and as a source of irrigation water. If the goal was to pump a chemical solution, powdered or granular material, or purified water from a storage tank, the pipes 50 and 52 would be isolated from the pipe 24.

A timing or pulse valve 58, such as Clayton 58-01 supplied by Cla-Val Co. of Newport Beach, Calif., is located between the gas outlet 36 and the junctions 46. The valve 58 automatically opens and closes every few seconds. A regulator valve 60, such as Clayton 50-01, is provided in each of the conduits 44 below the region A. These valves 60 respond to upstream gas pressure and open automatically when the pressure reaches a preset level. The regulator valves 60 operate in tandem, in response to the pulse valve 58, since the gas is distributed equally to each conduit 44. Other arrangements could be used such that the regulator valves 60 would operate at staggered times. But, such arrangements would normally be less practical since additional pulse valves or distribution valves would be used.

On account of the pulse valve 58 and regulator valves 60, gas enters the regions A in pulsed injections instead of a continuous flow. Pulsing the injections of gas allows the regions A to refill with fluid from the pipe 50 between pulses. Otherwise, gas could fill the conduits 44, whereupon no further liquid would be raised.

Check valves 62 are provided in the conduits 44 to allow gas to flow upwardly in the conduits but prevent fluid from the pipe 50 from flowing toward the chamber 12. Similarly, check valves 64 are provided to prevent gas from entering the pipe 50.

Isolation valves 66, 68 are provided as needed to close off branches of the system. It will be understood by a person of ordinary skill that the location of regulator valves, isolation valves, and check valves is not critical so long as these devices are selected and located so as to accomplish their purposes.

A reservoir 70 is located above the tank 10 to receive fluid raised in one or more of the conduits 44. Between the region A and reservoir 70, each conduit has one or more vertically extending loops 74, each such loop in a given conduit being at a different elevation. The loops serve as siphon break platforms to limit the downward flow of fluid in the conduits 44. Fluid collects in the trough at the bottom of each loop and is forced upwardly into the next vertical section of the conduit 44, when a pulse of gas is injected. By spacing the loops at appropriate elevations (e.g. a few feet apart for a three-inch diameter conduit), each injection of gas will lift the fluid in a given loop to the next higher loop in the series. The loops thus act as "stair steps" where a fluid can rest between pulses. And, when the pulses of gas are interrupted, the loop prevents the fluid from flowing back down to the base of the conduits. Any number of loops can be used. In addition, tubes (not shown) can carry a portion of the gas from the pipe 38, via appropriate pulse and regulator valves, for injection into upper regions of the conduits 44, e.g. in or below the uppermost loops. Such secondary injections of gas can boost or amplify the pumping effect whereever desired.

The air in the pipe 38 is provided by the automated filling and draining of the compression chamber 12. Accordingly, the tank 10 has a liquid outlet or drain 80 through which liquid can drain out of the chamber. The outlet is defined by a seat 82 which is adapted to receive a drain plug 84. A drain control means 86 includes the plug 84, a float 88 that rides on the surface of liquid received from the chamber 12. The plug 84 and float 88 are joined by a linkage which include a rod 90 and a flexible line such as a chain 92. All of the drain control apparatus is contained in a vessel 94. Means are provided to prevent the float 88 from descending to the bottom of the vessel 94, where it might become lodged in the outlet 80. Stops 95 limit the descent of the float 88, as does a rigid attachment between the float 88 and rod 90.

The interior of the vessel 94 communicates with the chamber 12 via a pipe 96 and a discharge tube 100 so that liquid inside the vessel 94 has the same level as liquid inside the chamber 12. If desired, the entire drain control apparatus could be included inside the chamber 12. A sight glass 102 is also provided to monitor the level of liquid in the chamber 12.

The tank 10 also includes a gas inlet 106 with a pressure activated valve 108 which opens automatically in response to negative pressure in the tank during draining and closes automatically in response to positive pressure in the tank during filling.

To control the flow of liquid entering the chamber 12, valve means 112 is provided. This valve means includes the discharge tube 100 and a flap gate 114 hingedly mounted to selectively close the liquid inlet 18. The gate is mounted in such a location that flow of liquid through the liquid inlet 18 urges the gate to move away from the inlet. And, the gate 114 may be spring loaded so that it is normally open. A piston 116 is provided in the discharge tube 100 and is connected to the gate 114 by a linkage 118 which could be a flexible cord or chain. As liquid drains from the chamber 12, through the discharge tube 100, the piston 116 is pushed toward the liquid outlet 80 which causes the linkage 118 to pull the flap gate 114 into a position where it at least partially closes the liquid inlet 18.

As previously mentioned, operation of this device is both simple and automatic. Assuming one starts with the chamber 12 filled with air and that the driving liquid and the fluid to be elevated are water from a common source, the procedure is as follows.

Water from the pipe 24 enters the tank 10 by gravity. As this water accumulates in the chamber 12, the air inside the chamber compresses and seeks to leave the tank. Regulator valve 58 allows pulses of air to egress through the gas outlet 36 and enter the manifold 40.

Air from the manifold 40 rises through the fluid conduits 44 where it encounters water which has been introduced into the region A of the conduits 44 from the fluid supply pipe 50. The air bubbles carry the water upwardly in the fluid conduits 44, in pulsed steps between the loops 74, until the water is elevated to the desired level, whereupon the mixture of air and water leaves the conduit and is received in the reservoir 70. With each burst of air entering the conduits 44, a burst of air and water moves up from each loop.

The water travels upwardly in periodic bursts, which appear as a boiling mixture of air and water. The agitation of this mixture is greatest just above the regions A, where air and water first mix, and reduces as the water moves upwardly. If no air is injected at an upper level, the water may appear as a pulsating (but nonboiling) stream as it enters the reservoir 70.

As the level of water in the chamber 12 rises, the vessel 94 also fills. When a predetermined maximum amount of liquid is reached, the float 88 pulls the plug 84 out of the drain seat 82 to commence draining. The buoyant plug 84 floats until draining is complete, whereupon the plug 84 returns to the seat 82, where it remains due to negative pressure below the outlet 80, while the chamber refills with liquid. Because a portion 92 of the linkage is flexible, the plug 84 can float until draining is complete. During draining, the liquid inlet 18 is closed by the flap gate 114, and air is admitted through the gas inlet 106 as previously described.

Once draining is complete and the plug 84 reseated, liquid filling commences automatically. As soon as the plug seats, flow stops through the discharge tube 100, whereupon pressure inside the pipe 26, optionally aided by a spring (not shown), pushes the flap gate 114 away from the liquid inlet 18 and refilling commences. Responding to an increase in pressure inside the chamber 12, the valve 108 closes automatically. The cycle then repeats continuously.

It will be apparent to those skilled in the art that many departures can be made both in the apparatus and process without departing from the spirit of the present invention. For example, the driving liquid could be other than water, and the gas other than air. As previously described, the fluid supplied in pipe 50 could be totally different fluid, such as a chemical solution or flow of powder, than the liquid which enters the chamber 12. And, it would be possible to relocate the valves and control mechanisms described. The invention should thus be accorded its full scope of protection and is considered to be limited only by the following claims.

I claim:

1. A fluid-raising apparatus comprising:

a tank which defines an airtight chamber, a liquid inlet for admitting a flow of liquid from an elevated source, a gas outlet to allow gas, displaced by entering liquid, to escape from the chamber, a liquid outlet to allow liquid to drain out of the chamber, and a gas inlet to allow gas to refill the chamber as the liquid drains;

an upwardly-extending fluid lift conduit communicating with the gas outlet, at a junction located below the top of the conduit, such that gas escaping from the chamber is injected into the conduit;

fluid supply means communicating with the conduit to repeatedly provide fluid therein in a region between the junction and the top of the conduit such that the fluid is carried upwardly in the conduit by the injected gas which rises in the conduit;

regulator valve means, between the gas outlet and the region, to cause gas to enter the region is pulsed injections so that, between injections, fluid from the fluid supply means can refill the region; and drain control means to open the liquid outlet when a predetermined maximum amount of liquid is present in the chamber and to close the outlet after liquid has drained from the chamber.

2. The apparatus of claim 1 further comprising reservoir means located above the tank to receive the fluid raised in the conduit.

3. The apparatus of claim 1 comprising multiple lift conduits, each communicating with the gas outlet and fluid supply means.

4. The apparatus of claim 1 further comprising gas conduit means for connecting the gas outlet to a fluid lift conduit that is at a remote location.

5. The apparatus of claim 1 further comprising a check valve adapted to allow the gas to flow from the regulator valve means toward the junction and to prevent the fluid from flowing toward the chamber.

6. The apparatus of claim 1 wherein the fluid lift conduit has one or more vertically extending loops above the region, each such loop being at a different elevation and serving as a siphon break platform to limit the downward flow of fluid in the fluid lift conduit.

7. The apparatus of claim 1 further comprising a pressure-activated valve connected to the gas inlet, the valve opening automatically in response to negative pressure in the chamber during draining and closing automatically in response to positive pressure in the chamber during filling with the liquid.

8. The apparatus of claim 1 wherein the fluid raised is from the same source as the liquid which fills the chamber.

9. The apparatus of claim 1 wherein the fluid raised is from a different source than the liquid which fills the chamber.

10. The apparatus of claim 1 wherein the regulator valve means comprises:

a pulse valve which opens at intervals to provide periodic pulses of gas; and a regulator valve located between the pulse valve and the region, the regulator valve being responsive to upstream gas pressure so that when a preset pressure level is reached by a pulse of gas, the regulator valve opens to allow the gas to enter the region.

11. A fluid-raising apparatus comprising:

a tank which defines an airtight chamber, a liquid inlet for admitting a flow of liquid from an elevated source, a gas outlet to allow gas, displaced by entering liquid, to escape from the chamber, a liquid outlet to allow liquid to drain out of the chamber, and a gas inlet to allow gas to refill the chamber as the liquid drains;

pump means, driven by the compressed gas obtained from the gas outlet, for raising a fluid;

drain control means to open the liquid outlet when a predetermined maximum amount of liquid is present in the chamber and to close the outlet after liquid has drained from the chamber; and valve means, to control flow through the liquid inlet, the valve means including an inlet plug mounted selectively to close the liquid inlet, a discharge tube which connects the chamber to the liquid outlet, a piston loosely contained in the discharge tube, and linkage means connecting the piston to the inlet plug in such a manner that, as liquid drains from the chamber, the piston is pushed toward the liquid outlet which causes the inlet plug to at least partially close the liquid inlet.

12. The apparatus of claim 11 wherein:

the inlet plug is a flap gate hingedly mounted in such a manner that flow of liquid through the liquid inlet urges the gate to move away from the inlet; and the linkage is a flexible cord which connects to the flap gate in such a manner that as the piston is pushed toward the liquid outlet, the cord pulls the flap gate into a position where it covers the liquid inlet.

13. The apparatus of claim 11 further comprising gas conduit means for connecting the gas outlet to a pump means that is at a remote location.

14. The apparatus of claim 11 further comprising a pressure-activated valve connected to the gas inlet, the valve opening automatically in response to negative pressure in the chamber during draining and closing automatically in response to positive pressure in the chamber during filling with the liquid.

15. The apparatus of claim 11 wherein the fluid raised is from the same source as the liquid which fills the chamber.

16. The apparatus of claim 11 wherein the fluid raised is from a different source than the liquid which fills the chamber.

17. A fluid-raising apparatus comprising:

a tank which defines an airtight chamber, a liquid inlet for admitting a flow of liquid from an elevated source, a gas outlet to allow gas, displaced by entering liquid, to escape from the chamber, a liquid outlet to allow liquid to drain out of the chamber, and a gas inlet to allow gas to refill the chamber as the liquid drains;

pump means, driven by the compressed gas obtained from the gas outlet, for raising a fluid;

a seat surrounding the liquid outlet and adapted to receive a drain plug; and drain control means to open the liquid outlet when a predetermined maximum amount of liquid is present in the chamber and to close the outlet after liquid has drained from the chamber, the control means including a buoyant drain plug adapted to form a seal with the seat, a float that rides on the surface of the liquid in the chamber, means to retain the float at a level above the liquid outlet, and a flexible line connecting the plug and the float such that, when the maximum amount of liquid is reached, the float pulls the plug out of the seat of commence draining, the buoyant plug floats until draining is complete, whereupon the plug returns to the seat where it remains, due to negative pressure downstream of the liquid outlet, while the chamber refills with liquid.

18. The apparatus of claim 17 further comprising gas conduit means for connecting the gas outlet to a pump means that is at a remote location.

19. The apparatus of claim 17 further comprising a pressure-activated valve connected to the gas inlet, the valve opening automatically in response to negative pressure in the chamber during draining and closing automatically in response to positive pressure in the chamber during filling with the liquid.

20. The apparatus of claim 17 wherein the fluid raised is from the same source as the liquid which fills the chamber.

21. The apparatus of claim 17 wherein the fluid raised is from a different source than the liquid which fills the chamber.

22. A fluid-raising apparatus comprising:

a tank which defines an airtight chamber, a liquid inlet for admitting a flow of liquid from an elevated source, a gas outlet to allow gas, displaced by entering liquid, to escape from the chamber, a liquid outlet to allow liquid to drain out of the chamber, and a gas inlet to allow gas to refill the chamber as the liquid drains;

multiple upwardly extending fluid conduits, each of which communicates with the gas outlet at a junction located below the top of the conduit, such that gas escaping the chamber is injected into each conduit, each conduit having one or more vertically extending loops above the junction, each such loop being at a different elevation and serving as a siphon break platform to limit the downward flow of fluid in the fluid lift conduit;

a fluid supply means communicating with the conduits to repeatedly provide fluid in each conduit in a region between the junction and the top of the conduit such that the fluid is carried upwardly in the conduit by injected gas which rises in the conduit;

regulator valve means, between the gas outlet and each region, such that gas enters region in pulsed injections and so that, between injections, fluid from the fluid supply means can refill the regions;

a check valve adaped to allow the gas to flow from the regulator valve toward each junction and to prevent the fluid from flowing toward the chamber;

a check valve adapted to allow the fluid to flow from the fluid supply means toward each conduit and to prevent the gas from flowing into the fluid supply means;

reservoir means located above the tank to receive the fluid raised in one or more of the conduits;

a seat for surrounding the liquid outlet and adapted to receive a drain plug;

drain control means to open the liquid outlet when a predetermined maximum amount of liquid is present in the chamber and to close the outlet after liquid has drained from the chamber, the control means including a buoyant plug adapted to form a seal with the seat, a float that rides on the surface of the liquid in the chamber, means to retain the float at a level above the liquid outlet, and a flexible line connecting the plug and the float such that, when the maximum amount of liquid is reached, the float pulls the plug out of the seat to commence draining, the buoyant plug floats until draining is complete, whereupon the plug returns to the seat where it remains, due to negative pressure downstream of the liquid outlet, while the chamber refills with liquid;

a pressure-activated valve connected the gas inlet, the valve opening automatically in response to negative pressure in the tank during draining and closing automatically in response to positive pressure in the chamber during filling with the liquid; and valve means, to control flow through the liquid inlet, the valve means including a flap gate hingedly mounted selectively to close the liquid inlet and mounted in such a location that flow of liquid through the liquid inlet urges the gate to move away from the inlet, a discharge tube which connects the chamber to the liquid outlet, a piston loosely contained in the discharge tube, and a flexible cord connecting the piston to the flap gate in such a manner that, as liquid drains from the chamber, the piston is pushed toward the liquid outlet which causes the cord to pull the flap gate into a position where it at least partially closes the liquid inlet.

* * * * *

UNITED STATES PATENT AND TRADEMARK OFFICE

CERTIFICATE OF CORRECTION

PATENT NO. : 4,643,650

DATED : February 17, 1987

INVENTOR(S) : KHAKZAD-GHOMI

It is certified that error appears in the above-identified patent and that said Letters Patent is hereby corrected as shown below:

In the Specification:

Column 1, line 39, "pior" should be --prior--.

In the Claims:

Column 6, line 4, "is" should be --in--.

Column 7, line 53, "of" second occurrence should be --to--.

Column 8, line 50, after "buoyant" should be --drain--.

Signed and Sealed this

Fifteenth Day of December, 1987

*Attest:*

DONALD J. QUIGG

*Attesting Officer*

*Commissioner of Patents and Trademarks*